US010932541B2

(12) United States Patent
Franklin et al.

(10) Patent No.: US 10,932,541 B2
(45) Date of Patent: Mar. 2, 2021

(54) SKIN TREATMENT DEVICE

(71) Applicant: KONINKLIJKE PHILIPS N.V., Eindhoven (NL)

(72) Inventors: Steven Ernest Franklin, Eindhoven (NL); Cornelis Petrus Hendriks, Eindhoven (NL); Lutz Christian Gerhardt, Eindhoven (NL); Hans Kroes, Eindhoven (NL); Daan Anton Van Den Ende, Eindoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 201 days.

(21) Appl. No.: 15/532,569

(22) PCT Filed: Dec. 3, 2015

(86) PCT No.: PCT/EP2015/078471
§ 371 (c)(1),
(2) Date: Jun. 2, 2017

(87) PCT Pub. No.: WO2016/091706
PCT Pub. Date: Jun. 16, 2016

(65) Prior Publication Data

US 2017/0325566 A1 Nov. 16, 2017

(30) Foreign Application Priority Data

Dec. 11, 2014 (EP) ..... 14197462

(51) Int. Cl.
*A45D 26/00* (2006.01)
*B26B 19/38* (2006.01)
*B26B 19/48* (2006.01)

(52) U.S. Cl.
CPC ..... *A45D 26/0061* (2013.01); *B26B 19/388* (2013.01); *B26B 19/48* (2013.01)

(58) Field of Classification Search
CPC ..... B26B 19/382; B26B 19/388; B26B 19/26; B26B 19/265; B26B 21/4012;
(Continued)

(56) References Cited

U.S. PATENT DOCUMENTS 8,348,472 B2 1/2013 Ackermann
8,667,692 B2 * 3/2014 Kraus ..... B26B 19/46 30/43.1

(Continued)

FOREIGN PATENT DOCUMENTS

CH 355713 A 7/1961
DE 102009010603 A1 5/2010

(Continued)

*Primary Examiner* — Evan H Macfarlane

(57) ABSTRACT

A device for treating skin includes a skin treatment member, a skin contacting surface, a mounting member for mounting the skin treatment member and the skin contacting surface, and a friction controlling device to control friction between the skin contacting surface and skin to be treated, in at least one controlled friction area of the skin contacting surface when the skin contacting surface is moved over the skin. The friction controlling device introduces a slip motion of the controlled friction area relative to the mounting member in a direction corresponding to a local direction of extension of the skin contacting surface. The device also includes a sensor for detecting a first parameter related to an amount of friction between the skin contacting surface and the skin during use, and the friction controlling device controls a second parameter of the slip motion in dependence on a value of the first parameter.

19 Claims, 6 Drawing Sheets

(58) Field of Classification Search
CPC ..... B26B 21/4018; B26B 21/4025; B26B 21/405; B26B 21/4056; A45D 26/0061
USPC ..... 30/34.2, 32, 34.05
See application file for complete search history.

(56) References Cited

U.S. PATENT DOCUMENTS

| | | | | |
|---|---|---|---|---|
| 2007/0089297 | A1* | 4/2007 | Houbolt | B26B 21/22 30/34.2 |
| 2007/0227006 | A1* | 10/2007 | Aviza | B26B 21/4018 30/41 |
| 2010/0076367 | A1 | 3/2010 | Ackermans | |
| 2011/0146087 | A1* | 6/2011 | Sinner-Hettenbach | B23D 51/20 30/393 |
| 2015/0128776 | A1* | 5/2015 | Zuidervaart | B26B 19/42 83/18 |
| 2015/0224653 | A1* | 8/2015 | Narita | B26B 19/04 30/43.9 |

FOREIGN PATENT DOCUMENTS

| | | | |
|---|---|---|---|
| EP | 1764010 | A1 | 3/2007 |
| FR | 2749793 | A1 | 12/1997 |
| FR | 2810516 | A1 | 12/2001 |
| JP | 9-206483 | | 8/1997 |
| JP | 2003181165 | A | 7/2003 |
| JP | 2014-030476 | | 2/2014 |
| WO | 2005056251 | A1 | 6/2005 |
| WO | 2013140309 | A1 | 9/2013 |

* cited by examiner

SKIN TREATMENT DEVICE

This application is the U.S. National Phase application under 35 U.S.C. § 371 of International Application No. PCT/EP2015/078471, filed on Dec. 3, 2015, which claims the benefit of International Application No. 14197462.6 filed on Dec. 11, 2014. These applications are hereby incorporated by reference herein.

FIELD OF THE INVENTION

The invention relates to a skin treatment device comprising a skin treatment member for performing a skin treatment, a skin contacting surface, separate from the skin treatment member, for contacting the skin to be treated, a mounting member for mounting the skin treatment member and the skin contacting surface in the skin treatment device, and friction controlling means configured and arranged to control friction between the skin contacting surface and the skin to be treated, in at least one controlled friction area of the skin contacting surface, during use when the skin contacting surface is moved over the skin.

BACKGROUND OF THE INVENTION

WO 2013/140309 A1 discloses a shaver comprising a cutting element and a guard having a skin engaging portion. The skin engaging portion comprises a force-generating member that can be selectively activated during use to increase or decrease a force of attraction exerted on the skin of a user. The force-generating member may comprise electro-adhesive elements, wherein a controller may be provided to selectively activate these elements.

In the field of electric and laser shaving, there is always a balance between closeness of the shaving process and skin irritation. This balance is controlled by the amount of skin doming occurring when the shaver is moved over the skin surface, wherein skin doming is defined as deformation of the skin through the hair-entry apertures in the skin engaging portion. Skin doming is greatly influenced by the skin friction behavior as well as the local skin mechanical properties and the device use characteristics such as load and movement speed. WO 2013/140309 A1 describes a way of controlling skin friction in order to realize an optimum case in which the skin can be stretched by a higher friction at the leading edge of the skin engaging portion and a lower friction (skin gliding) at the trailing edge of the skin engaging portion, and in which the local setting of the friction can be controlled depending on the movement direction of the shaver over the skin. In the shaver known from WO 2013/140309 A1, friction control is achieved by selectively activating the force-generating member of the skin engaging portion during use to adjust a force of attraction to the skin of a user.

EP 1 764 010 A1 discloses an electrical shaver comprising a shaving attachment carrying a first hair-cutting member for cutting long hairs and a second hair-cutting member for cutting short hairs, wherein, seen in a motion direction of the shaver over the skin, the first hair-cutting member is arranged in front of the second cutting member. The shaving attachment further comprises a skin-abrading member which is arranged behind the first and second cutting members, seen in the motion direction. The skin-abrading member comprises an oblong skin-abrading element, which extends perpendicularly to the motion direction, and drive means to reciprocatingly move the skin-abrading element in its direction of extension.

FR 2 810 516 A1 discloses an epilating device comprising a rotatable epilating cylinder with co-operating clamping elements for clamping hairs and extracting the hairs from the skin. The epilating device comprises an oblong skin-contacting member, which is arranged adjacent to the epilating cylinder and extends perpendicularly to the epilating cylinder and which is in contact with the skin during use of the epilating device. The epilating device further comprises drive means to generate a reciprocating motion of the skin-contacting member in its direction of extension. During use the skin-contacting member provides a skin-massaging effect, which reduces pain sensation experienced by the user as a result of the hair-extraction process.

SUMMARY OF THE INVENTION

It is an object of the invention to provide a way of achieving friction control at a skin contacting surface of a skin treatment device such as a shaver, which is different from the way known from WO 2013/140309 A1, yet at least as effective.

According to the invention, a skin treatment device is provided which comprises a skin treatment member for performing a skin treatment, a skin contacting surface, separate from the skin treatment member, for contacting the skin to be treated, a mounting member for mounting the skin treatment member and the skin contacting surface in the skin treatment device, and friction controlling means configured and arranged to control friction between the skin contacting surface and the skin to be treated, in at least one controlled friction area of the skin contacting surface, during use when the skin contacting surface is moved over the skin, wherein the friction controlling means are adapted to introduce a slip motion of the controlled friction area relative to the mounting member in a direction corresponding to a local direction of extension of the skin contacting surface, and wherein the skin treatment device comprises sensing means configured and arranged for detecting a first parameter, which is related to a friction between the skin contacting surface and the skin during use, wherein the friction controlling means are adapted to control a second parameter of the slip motion in dependence on a value of the first parameter detected by the sensing means.

By applying the invention, the friction between the skin contacting surface and the skin, which occurs when the skin treatment device is moved over the skin, is controlled by introducing a slip motion into one or more controlled friction areas of the skin contacting surface, relative to the mounting member of the skin treatment device, in a direction corresponding to a local direction of extension of the skin contacting surface, and by controlling the slip motion. The local direction in which the skin contacting surface extends is an overall direction in which the skin contacting surface extends in case the skin contacting surface is planar, i.e. free from curves. In particular, the slip motion is controlled in dependence on the value of a first parameter, detected by the sensing means, which first parameter is related to an amount of friction between the skin contacting surface and the skin during use. In this context, the expression "parameter related to a friction" means either a parameter which is influenced by said friction, for example by an amount, a direction or another property said friction, or a parameter which influences said friction, for example an amount, a direction or another property of said friction. Suitable examples of such a parameter will be described in the following. In particular, based on the detected value of the first parameter, a second parameter of the slip motion is controlled, in particular a motion parameter of the slip motion such as, for example, a velocity, a frequency or an amplitude of the slip motion. The invention is based on the insight that a slipping contact between surfaces in a direction other than a general direction of a relative motion of the surfaces leads to a reduction of the friction prevailing between the surfaces in said relative motion direction. According to the invention, in the context of a skin treatment device, this insight is applied to locally reduce friction between the skin contacting surface and the skin during use in the motion direction of the skin treatment device at appropriate areas. Reduction of the friction may for example be used to influence an amount of local skin stretching when using a skin treatment device wherein the efficiency of the skin treatment member or comfort experienced by the user is influenced by local skin stretching. By measuring the first parameter, which influences or is influenced by the friction between the skin contacting surface and the skin during use, and controlling the slip motion in dependence on said first parameter, said first parameter can for example be adjusted or controlled to a desired value or within a desired range of values. For example, when the invention is applied in a shaver, the amount of skin doming may be reduced or controlled and the closeness-irritation balance may be optimized, whereby the overall end effect is a close shaving process with minimal irritation.

In an embodiment of the skin treatment device according to the invention, the skin treatment member defines a main motion direction of the skin treatment device, and the friction controlling means are configured and arranged to introduce the slip motion in a direction deviating from the main motion direction. Particularly, the main motion direction of the skin treatment device is a direction in which the user is supposed to move the skin treatment device during use of the device in a normal, usual or prescribed manner. For example, in case of a shaver having an oblong hair-cutting member with a cutter reciprocatingly moving in the main direction of extension of the oblong hair-cutting member, the main motion direction usually is a direction perpendicular to the direction of the reciprocating motion of the cutter. In case of an epilator having an epilating cylinder rotating about an axis of rotation, the main motion direction usually is a direction perpendicular to the axis of rotation. The skin treatment member may also define more than one main motion direction, such as for example in case of a circular shaving head comprising a rotating cutter which may be moved in any direction over the skin surface. By introducing the slip motion in a direction deviating from the main motion direction, the friction between the skin contacting surface and the skin, experienced when moving the device in the main motion direction, is effectively reduced. It is noted that the direction of the slip motion is preferably a direction transverse to the main motion direction of the skin treatment device, i.e. a direction perpendicular or nearly perpendicular to the main motion direction, which does not alter the fact that another orientation of the slip motion relative to the main motion direction is possible as well, as long as the slip motion has a substantial component in the direction transverse to the main motion direction.

In order to obtain a stretching effect on the skin as mentioned in the foregoing, it is advantageous for the controlled friction area to be located in a trailing position relative to the skin treatment member, seen in the main motion direction of the skin treatment device. In many types of skin treatment devices it is possible to derive, from the orientation of various functional components, in particular the orientation of the skin treatment member of the skin treatment device, how the device is intended to be moved across the skin to be treated by means of the device, i.e. to derive the main motion direction in which the user is supposed to move the skin treatment device over the skin to achieve normal prescribed operation of the device. Therefore, it is possible to arrange the at least one controlled friction area in an appropriate trailing position, seen in the main motion direction, for obtaining the skin stretching effect during use.

In a practical application of the invention, the second parameter is a maximum velocity of the slip motion, and the friction controlling means are adapted to set said maximum velocity to a value in a range of 1 to 100 mm/s. Experiments performed in the context of the invention have shown that a relatively modest velocity of the slip motion, for example a maximum velocity in a range of 2 to 5 mm/s in the case of a reciprocating slip motion, already causes a significant reduction of friction on human skin when the skin treatment device is moved over the skin at a usual speed. Such a significant effect enables good control of the friction with low speed vibrations, so that the vibrations will affect comfort of use of the device according to the invention to only a limited or negligible extent.

In a further embodiment of a skin treatment device according to the invention, wherein the slip motion is a reciprocating slip motion of the controlled friction area, the second parameter is a frequency of the slip motion, and the friction controlling means are adapted to set said frequency in a range of 0.1 to 100 Hz. By controlling the frequency of the reciprocating slip motion of the controlled friction area of the skin contacting surface, for example for a predefined constant value of the amplitude of the slip motion, the friction between the skin contacting surface and the skin can be controlled in an effective manner.

In a still further embodiment of a skin treatment device according to the invention, wherein the slip motion is a reciprocating slip motion of the controlled friction area, the second parameter is an amplitude of the slip motion, and the friction controlling means are adapted to set said amplitude in a range of 0.1 to 10 mm. By controlling the amplitude of the reciprocating slip motion of the controlled friction area of the skin contacting surface, for example for a predefined constant value of the frequency of the slip motion, the friction between the skin contacting surface and the skin can be controlled in an effective manner.

It is noted that, to control the friction caused by the slip motion, according to the invention it is also possible to control a combination of two or more parameters of the slip motion, e.g. the frequency and the amplitude in case of a reciprocating slip motion.

Particularly, in a skin treatment device which can be moved in various directions across the skin to be treated, it is practical when the first parameter is an actual motion direction of the skin treatment device during use, and when the friction controlling means are adapted to introduce the slip motion when the controlled friction area is in a trailing position relative to the skin treatment member, seen in the actual motion direction of the skin treatment device, and to prevent the slip motion when the controlled friction area is in a leading position relative to the skin treatment member, seen in the actual motion direction of the skin treatment device. In this embodiment, the first parameter is an example of a parameter which influences the friction between the skin contacting surface and the skin, in particular the direction of the friction. With this embodiment it is achieved that, during use of the skin treatment device, friction at the trailing position of the skin contacting surface, seen in the actual motion direction of the device over the skin, is reduced, so that the skin can be stretched by means of the friction on the skin at the leading position of the skin contacting surface, while gliding of the skin takes place at the trailing position. In a skin treatment device which can be moved in various directions across the skin to be treated, various controlled friction areas may be present along the periphery of the skin contacting surface, wherein measures are taken to ensure that the slip motion is always introduced into the one or more controlled friction areas which appear to be in a trailing position relative to the skin treatment member, seen in the actual motion direction in which the skin treatment device is actually moved, as detected by the sensing means. Therefore, a change of the actual motion direction of the skin treatment device brings about a change of the controlled friction area(s) which is/are activated such as to realize the slip motion. In this embodiment, the device is equipped with sensing means for detecting the actual motion direction of the skin treatment device during use and providing the friction controlling means with information regarding the detected actual motion direction. The friction controlling means may have a controller to select, as a function of the detected actual motion direction, those controlled friction area(s) which are to be activated and those which are not to be activated.

The skin treatment device according to the invention may comprise user-operable activating means allowing a user to activate the friction controlling means when desired. For example, in a one-way shaver comprising a number of skin contacting surfaces and a controlled friction area in each skin contacting surface, at a position which is a trailing position in the main motion direction of the shaver, a user may decide to activate the controlled friction areas in order to locally reduce friction at the appropriate positions for reducing skin irritation. The user-operable activating means may comprise a button, for example.

According to another option, which is also applicable to shavers and any other type of skin treatment device in which the skin contacting surface is provided with one or more hair-entry apertures, the first parameter is an amount of skin doming in the hair-entry aperture during use. In this embodiment, the first parameter is an example of a parameter which is influenced by the friction between the skin contacting surface and the skin, in particular by the amount of said friction. In this embodiment, sensing means may be applied for detecting the amount of skin doming in the hair-entry apertures during use and providing the friction controlling means with information regarding the detected amount of skin doming, for example optical sensing means. The friction controlling means may have a controller to adapt, as a function of the detected amount of skin doming, the second parameter of the slip motion of the controlled friction area such that, for example in case the detected amount of skin doming appears to be above a predetermined threshold, the amount of skin doming is reduced to a desired optimum amount.

In a further embodiment of the skin treatment device according to the invention, the first parameter is an actual velocity of the skin treatment device relative to the skin during use. In this embodiment, the second parameter of the slip motion is controlled or adjusted in dependence on the actual value of the velocity with which the skin treatment device is moved over the skin. This embodiment has the advantage that, when the velocity is for example increased by the user, the amount of the side slip motion, for example the maximum velocity thereof, can be increased in order to maintain the friction force at a desired amount. For example, in case of a reciprocating side slip motion having a sinusoidal velocity profile, the maximum velocity of the side slip motion should be about 2 times higher than the velocity of the skin treatment device in order to realize a 50% reduction of the friction between the controlled friction area and the skin.

In a practical embodiment of the skin treatment device according to the invention, the friction controlling means comprise at least one strip which is movable relative to the mounting member in a longitudinal direction of the strip. In order to achieve an optimal friction reducing effect in an embodiment wherein the skin treatment device has a main motion direction, it is advantageous for the strip to be arranged such as to extend in a direction which is perpendicular or nearly perpendicular to the main motion direction of the skin treatment device during use.

In case at least one strip as mentioned is applied in the skin treatment device according to the invention, any suitable type of actuating means may be used for realizing a reciprocating motion of the strip relative to the mounting member in the longitudinal direction of the strip. According to one feasible option, actuating means comprising a responsive material are implemented in the skin treatment device. Such actuating means may comprise an electro-active polymer, which may be a piezo-electric polymer or an electrostrictive polymer. Furthermore, such actuating means may comprise two elongated actuating elements of an expandable material, wherein first end portions of the two elongated actuating elements are connected to the strip at a central position in the longitudinal direction of the strip. In that case, it is possible for second end portions of the two elongated actuating elements to be connected to a common fixed base in the skin treatment device, in particular the mounting member of the skin treatment device. However, it is more effective when the first end portions of the two elongated actuating elements are connected to, respectively, a first end portion of the strip and a second end portion of the strip, and when the second end portions of the two elongated actuating elements are connected to the mounting member in positions in the vicinity of, respectively, the second end portion of the strip and the first end portion of the strip, because higher actuation amplitudes can be realized in such a configuration.

In the case of a strip having a width of about 0.5 to 1 mm, an amplitude of the reciprocating slip motion having a value in a range of 1 to 2 mm is estimated to be sufficient to result in true slip at the skin interface for all skin conditions. A driving frequency of the reciprocating slip motion having a value in a range of 0.5 to 1 Hz would result in a velocity of 2 mm/s. This frequency is well within a typical electro-active polymer driving frequency range and is low enough for avoiding inconvenience for a user as a result of the vibrations.

For the sake of completeness, it is noted that the friction controlling means may comprise a number of parallel strips which are movable relative to the mounting member in their longitudinal direction and which extend alongside each other in at least one controlled friction area. If that is the case, it is preferred that, during use, the strips have a reciprocating motion according to an alternating pattern wherein adjacent strips are moved in opposite directions, so that only a minimal amplitude of the motion of the strips is needed for realizing the skin gliding effect as required, and so that the vibrations of the skin treatment device are minimized. It is possible to have actuating means which are capable of realizing such an alternating motion pattern of the strips, wherein it is noted that the above remarks regarding the practical embodiments of the actuating means are also applicable to actuating means which are suitable for driving more than one strip. In the case of more than one strip, in order to realize the preferred alternating motion pattern of the strips, it is preferred for the actuating means to comprise at least one separate actuating element per strip, such as a piece of an expandable material as mentioned in the foregoing.

The friction controlling means may be adapted to realize a slip motion of a reciprocating nature, for example, by means of the strips as described in the foregoing. Alternatively, within the framework of the invention, the friction controlling means may be adapted to realize a slip motion of a continuous nature, i.e. in a single direction. One practical possibility of realizing such type of slip motion involves an application of at least one roller in the controlled friction area, wherein the roller is driven such as to rotate continuously in a predetermined direction when actuated. In skin treatment devices which can be freely moved across a portion of skin in various directions according to the preference of a user, it is advantageous when at least two rollers are present, and when these rollers are positioned such as to have different orientations, which may be mutually perpendicular orientations.

The skin treatment device according to the invention may be of the type which is adapted to perform a cutting action on hairs as present on an area of skin, comprising at least one movably arranged cutting element for cutting off the hairs and a guard having a skin engaging portion, in which case it is practical for the controlled friction area to be located alongside a periphery of the skin engaging portion. Thus, the skin treatment device according to the invention may be a shaver, a trimming device or a grooming device, in which case the skin treatment member is a movably arranged cutting element and the skin contacting surface, separate from the skin treatment member, is a skin engaging portion of a guard. That does not alter the fact that the invention is applicable to other types of skin treatment devices as well, including epilators, in which case the skin treatment member is a movably arranged element for engaging with hairs to be removed from an area of skin. Other feasible examples of skin treatment devices are skin firming devices involving mechanical skin deformation, mechanical skin massage devices, anti-cellulitis devices based on mechanical skin deformation principles, skin rejuvenation devices based on mechanical skin deformation principles, devices for treatment of eye bags/dark circles underneath the eye on the basis of mechanical deformation of the tissue, and breast pump devices for mechanical stimulation of milk production.

The above-described and other aspects of the invention will be apparent from and elucidated with reference to the following detailed description of shavers comprising a skin contacting surface in which a number of controlled friction areas are present. Furthermore, the application of the invention in a photo-epilator will be described as an example of the numerous possible applications of the invention. The fact that the invention will be explained in the context of the skin treatment devices as mentioned should not be understood such as to imply that the invention cannot be used in other contexts, as already mentioned in the foregoing.

BRIEF DESCRIPTION OF THE DRAWINGS

The invention will now be explained in greater detail with reference to the figures, in which equal or similar parts are indicated by the same reference signs, and in which.

DETAILED DESCRIPTION OF EMBODIMENTS

Figure 1:
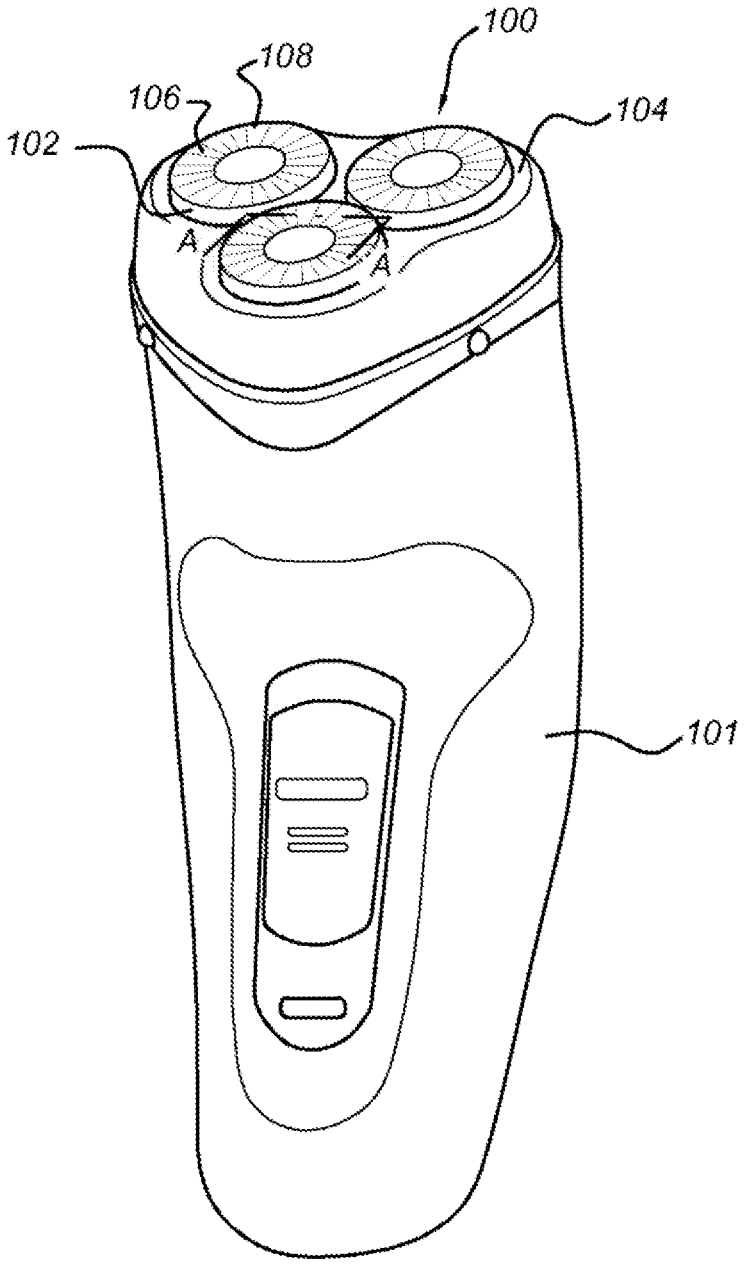
Fig. 1 (PRIOR ART)
FIG. 1 shows a perspective view of a conventional rotary shaver.

FIG. 1 illustrates a conventional rotary electric shaver 100 used for "dry" shaving. The shaver 100 comprises a main body 101 and three skin treatment members or heads 102 mounted in a stationary mounting member or face plate 104. Each of the heads 102 includes a rotating cutting element (not shown in FIG. 1) and an outer cap 106 serving as a guard of the cutting element, having a plurality of hair-entry apertures 108 through which hairs may enter into the cap 106 to be cut by the cutting element. During use of the shaver 100, the main body 101 is held by a user and the face plate 104 is moved across the user's skin so that the outer caps 106 of the heads 102 contact the skin and hairs to be cut are caught by the hair-entry apertures 108 of the outer caps 106.

Figure 2:
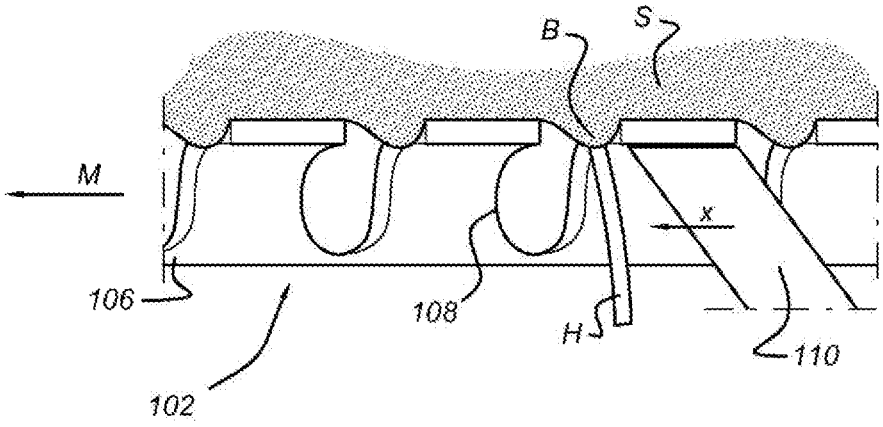
Fig. 2 (PRIOR ART)
FIG. 2 shows a partial cross-section through the conventional rotary shaver along line A-A in FIG. 1.

FIG. 2 shows a detail through one of the heads 102 taken on line A-A in FIG. 1. For the sake of illustration, a hair H protruding through a hair-entry aperture 108 of the outer cap 106 is depicted, wherein the cutting element 110 is shown moving in a direction X to cut the hair H by interaction with the hair-entry aperture 108 in an otherwise conventional way. FIG. 2 also shows the manner in which the skin S bulges into the hair-entry apertures 108 at B, i.e. the manner in which skin doming takes place. In this view, the face plate 104 moves in a motion direction M relative to the skin S, which corresponds to the direction X of the motion of the cutting element 110. The bulge B is therefore pushed against one side of the hair-entry aperture 108. It will however be understood that the cutting element 110 rotates and its local direction of motion X therefore does not always correspond to the motion direction M of the face plate 104 across the skin S. It is noted that, because the heads 102 have a fixed position in the face plate 104, the motion direction M of the face plate 104 is also the direction of motion of the heads 102 and the outer caps 106, which are part of the heads 102. Furthermore, the motion direction M of the face plate 104 corresponds to a main motion direction of the shaver 100 in which the user is assumed to move the shaver 100 over the skin S.

Due to the bulge B of skin into the hair-entry apertures 108, the skin S may become damaged by contact with the cutting element 110. This damage may be reduced by various means, including increasing the thickness of the outer cap 106 and reducing the width of the hair-entry apertures 108. However, such adaptations have a negative effect on the closeness of the shaving process that can be achieved. The invention provides another solution when it comes to taking measures for realizing an advantageous closeness-irritation balance, as will be explained in the following.

Figure 3:
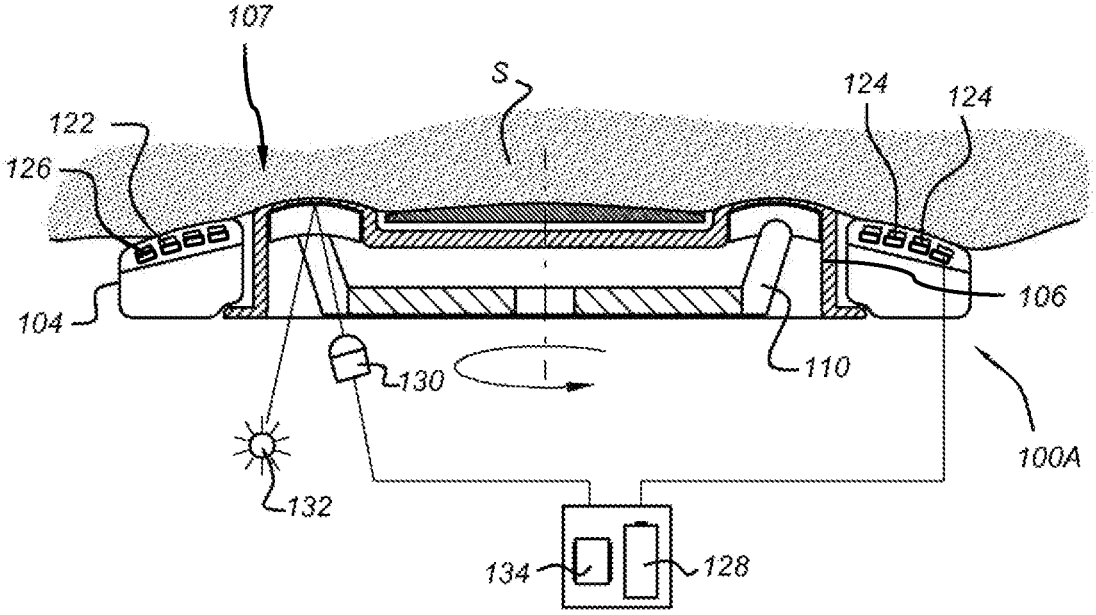
FIG. 3 shows a schematic cross-section through a part of a rotary shaver according to the invention.

FIG. 3 shows a schematic cross-section through a part of a rotary shaver 100A according to the invention. Like elements to those of FIGS. 1 and 2 will be designated with like numerals, even though FIGS. 1 and 2 relate to a conventional situation whereas FIG. 3 relates to the invention.

In the embodiment of the rotary shaver 100A according to the invention shown in FIG. 3, controlled friction areas 122 are located on the mounting member or face plate 104. In each of the controlled friction areas 122, a plurality of strips 124 are present, wherein the strips 124 are arranged such as to be movable in their longitudinal direction L, wherein the strips 124 extend alongside each other, and wherein actuating means 126 are provided for actuating the strips 124 and causing them to perform a reciprocating motion during use of the shaver 100A. The actuating means 126 are connected to a voltage source 128. In general, by putting the strips 124 as present in a controlled friction area 122 in motion during use, the friction at the interface with the skin S is reduced at the position of the controlled friction area 122, and by having controlled friction areas with different frictions, it is possible to stretch the skin S to some extent in order to reduce the height of the bulge B of the skin S, i.e. to reduce the amount of skin doming without directly affecting the closeness of the shaving process in any way. In FIG. 3, the overall skin contacting surface of the rotary shaver 100A according to the invention, which comprises an outer surface of the outer caps 106 and a main surface of the strips 124 (i.e. the controlled friction areas 122), is indicated by means of reference numeral 107.

In the shown example, a sensor 130 is located on the face plate 104 for determining the degree of skin doming. The sensor 130 is an IR photodiode which operates together with an IR LED 132 to determine the doming of the skin S through the hair-entry apertures 108 in the outer cap 106, which is an example of a first parameter related to the friction, in particular the amount of friction, between the skin contacting surface 107 and the skin S, in particular a parameter which is influenced by said friction. The sensor 130 and the LED 132 are both connected to a controller 134, which includes appropriate circuitry for processing their signals. In use, the LED 132 emits IR light, which is reflected by the skin S. The controller 134 is set to determine the height of the bulge B and control the voltage source 128 for powering the actuating means 126 of one or more appropriate controlled friction areas 122 to actuate the strips 124 in those controlled friction areas 122, for example when the bulge B appears to be higher than an allowable maximum. By controlling of the voltage source 128 by the controller 134, a second parameter associated with the slip motion of the actuated strips 124 is controlled in dependence on the first parameter, i.e. the measured height of the bulge B. In particular, said second parameter is a motion parameter of the slip motion the actuated strips 124, e.g. a maximum velocity, a frequency or an amplitude of the slip motion. Control of the second parameter may be, for example, such as to maintain a desired optimum height of the bulge B. In the present embodiment, skin doming through the outer cap 106 is measured, but it is understood that skin doming may be measured at various positions including at a recess formed in the face plate 104, ahead of the face plate 104 or between the face plate 104 and the outer cap 106.

Figure 4:
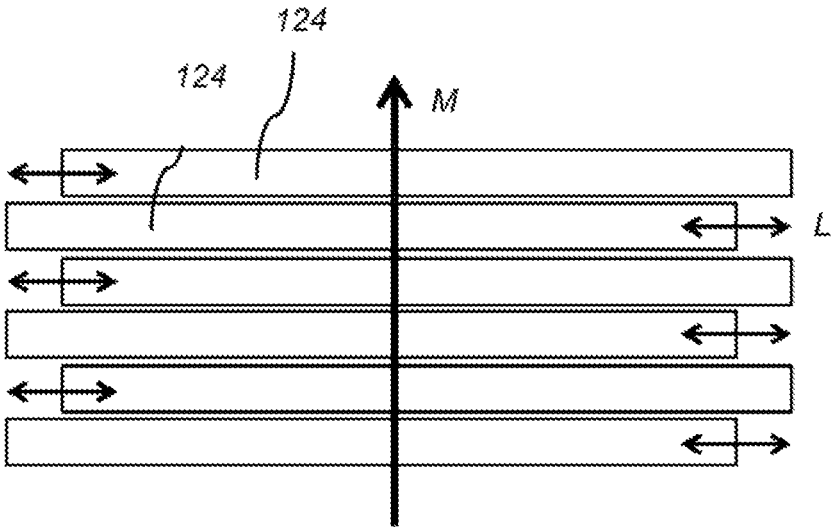
FIG. 4 shows a configuration of a number of strips which are present in a controlled friction area of the rotary shaver according to the invention.
Figure 5A:
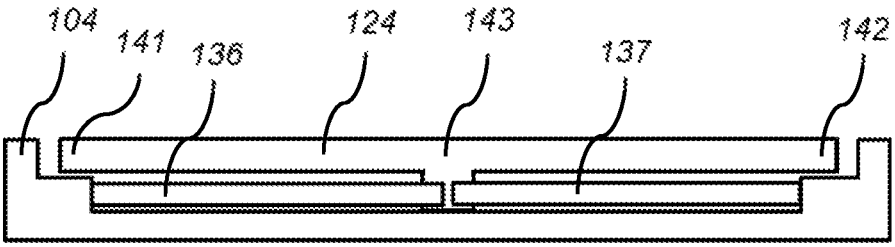
FIGS. 5*a* and 5*b* illustrate two different options in respect of actuators for the strips.
Figure 5B:
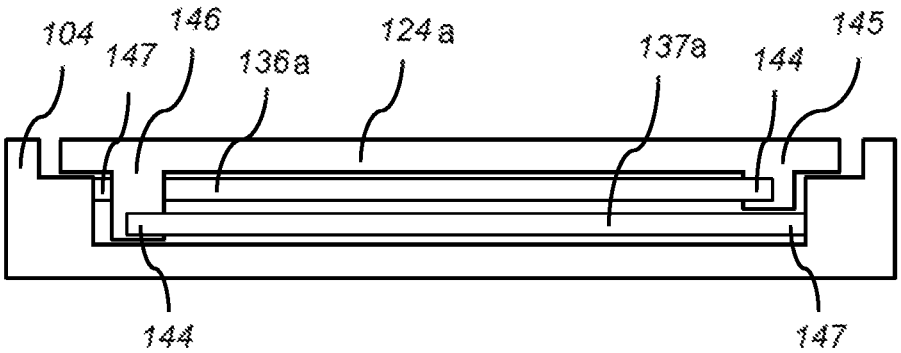

FIGS. 4, 5*a*, and 5*b* show further details of the strips 124, as present in a controlled friction area 122, and the actuating means 126 for actuating the strips 124. The strips 124 are intended to perform a slip motion with respect to the mounting member or face plate 104 and the skin S in a longitudinal direction L of the strips 124. Thus, the slip motion is substantially perpendicular to the main motion direction M of the shaver 100A across the skin S, and is in a direction corresponding to a local direction of extension of the skin contacting surface 107 which, in the present case, is parallel to the planar surface of the strips 124. In FIG. 4, the main motion direction M of the shaver 100A is indicated by means of a vertical arrow, whereas the slip motion of the strips 124 is indicated by horizontal arrows which are two headed in order to reflect the reciprocating nature of the motion of the strips 124. The assumption underlying FIG. 4 is that the strips 124 have a transverse orientation with respect to the main motion direction M, which is optimal for obtaining a friction reducing effect on the basis of the slip motion of the strips 124 relative to the face plate 104 and the skin S in the controlled friction area 122. For the sake of completeness, it is noted that the strips 124 may also have another orientation with respect to the main motion direction M in order to obtain the effect as mentioned, as long as the orientation is not exactly parallel to the main motion direction M. However, in the following, for the sake of explanation of the invention, the transverse orientation is assumed.

Each controlled friction area 122 of the rotary shaver 100A according to the invention may comprise a number of strips 124 as illustrated in FIG. 4, but it is also possible that one strip 124 is applied per controlled friction area 122. The strips 124 can be made of any suitable material, e.g. a polymer or stainless steel. In general, the strips 124 can be placed on the plastic housing of a rotary shaver, the housing of a foil shaver, or on a cartridge in laser shaving. Actuation of the strips 124 may be realized by using electro-active polymer (EAP) technology. This technology uses very soft polymers which are capable of deforming to a large extent, i.e. more than 10%. Mechanically stiffer electro-active polymers include piezo-electric polymers (PVDF) and electro-strictive polymers (PVDF-TrFe—CFe). Said electro-strictive polymers can exert a higher mechanical force in return for more modest strain levels (1-7%), which may be more appropriate in respect of the intended application in the shaver 100A according to the invention. In particular, the activation of a reciprocating motion or vibration of the strips 124 can be realized through alternating expansion and contraction of actuating elements comprising a suitable electro-active polymer which is electrically activated by means of the voltage source 128.

In order to locally reduce the friction between the skin S and the skin contacting surface 107 at the position of the strips 124 in the main motion direction M of the rotary shaver 100A, it needs to be ensured that actual slip occurs at the shaver-skin interface. Because the human skin is very flexible in the lateral direction, i.e. the direction perpendicular to the main motion direction M, the amplitude of the reciprocating motion of the strips 124 must be large enough to overcome the static phase in which the skin S is stretched laterally but no actual slip occurs. The required amplitude depends on several factors including the friction coefficient (which is dependent on the condition of the skin S), the width of the strips 124, and the number of strips 124. In this respect, it is advantageous to use strips 124 having a relatively small width and to move adjacent strips 124 in opposite directions in the plane in which the strips 124 extend. For example, in case the strips 124 have a width of about 0.5 to 1 mm, an amplitude of the reciprocating motion of 1 to 2 mm is estimated to be sufficient to result in true slip at the skin interface for all skin conditions. A frequency of the reciprocating motion of 0.5 to 1 Hz (square wave) would result in a maximum velocity of the slip motion of 2 mm/s. Preferably, in order to achieve a substantial reduction of the friction the maximum velocity of the slip motion is considerably higher than the overall velocity of the rotary shaver 100A in the main motion direction. For example, for a reciprocating side slip motion having a sinusoidal velocity profile, the maximum velocity of the side slip motion should be about 2 times higher than the velocity of the skin treatment device in order to realize a 50% reduction of the friction between the controlled friction area and the skin.

A first example of achieving the desired actuation of the strips 124 using an electro-active polymer is shown in FIG. 5*a*. In particular, according to this example, each strip 124 is associated with two elongated actuating elements 136, 137 of the polymer, wherein each of the actuating elements 136, 137 extends between the mounting member 104, in the vicinity of a respective one of a first end portion 141 and a second end portion 142 of the strip 124, and a central portion 143 of the strip 124. In this configuration, the actuating elements 136, 137 are actuated alternately, causing a reciprocating motion of the strip 124. For example, PVDF-TrFe—CFe polymers typically expand about 5%, which provides an amplitude of the reciprocating motion of 1 mm for a 4 cm long strip 124. The actuating elements 136, 137 may be slightly pre-stretched in order to avoid buckling.

FIG. 5*b* illustrates an option for achieving higher amplitudes of the reciprocating motion of a strip 124*a*, which is based on the idea that the effective length of the strip 124*a* can be increased by changing the position where actuating elements 136*a*, 137*a* are attached to the strip 124*a*. According to the example as shown in FIG. 5*b*, the actuating elements 136*a*, 137*a* do not engage the strip 124*a* at a central portion. Instead, first end portions 144 of the two actuating elements 136*a*, 137*a* are connected to, respectively, a first end portion 145 of the strip 124*a* and a second end portion 146 of the strip 124*a*, and second end portions 147 of the two actuating elements 136*a*, 137*a* are connected to the mounting member 104 in positions in the vicinity of, respectively, the second end portion 146 of the strip 124*a* and the first end portion 145 of the strip 124*a*. Thus, the actuating elements 136*a*, 137*a* are about twice as long as in the first example shown in FIG. 5*a*, as a result of which the amplitude of the reciprocating motion of the strip 124*a* is about 2 mm for a 4 cm long strip 124*a*. In any case, the use of electro-active polymers for actuating the strips 124*a* does not require significant additional space in the face plate 104, as a thickness of the actuating elements 136*a*, 137*a* in an order of 100 μm suffices.

Figure 6:
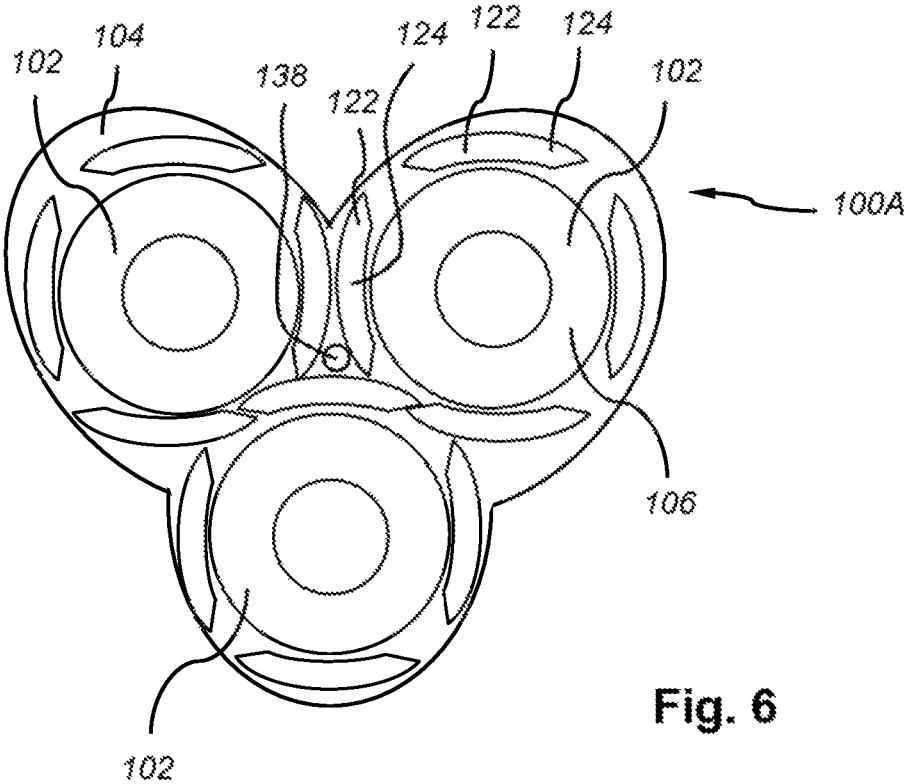
FIG. 6 shows a frontal view of a skin contacting surface of the rotary shaver according to the invention, including a number of controlled friction areas.

FIG. 6 shows a frontal view of a mounting member or face plate 104 of the rotary shaver 100A according to the invention. Besides the three heads 102, a number of controlled friction areas 122 can be seen in this view. In particular, in the shown example, each head 102 is surrounded by four controlled friction areas 122, wherein the controlled friction areas 122 have an elongated shape and are more or less arranged according to a square encompassing the associated head 102. Which one of the four controlled friction areas 122 is activated in an actual situation depends on an actual motion direction M' of the rotary shaver 100A across the skin S. The fact is that in order to reduce skin doming, it is desirable to have an area of reduced friction in the skin contacting surface in a trailing position with respect to the head 102, seen in the actual motion direction M'. This can be achieved by actuating the strips 124 of the controlled friction areas 122 which are in a trailing position as mentioned during use of the shaver 100A.

Figure 7A:
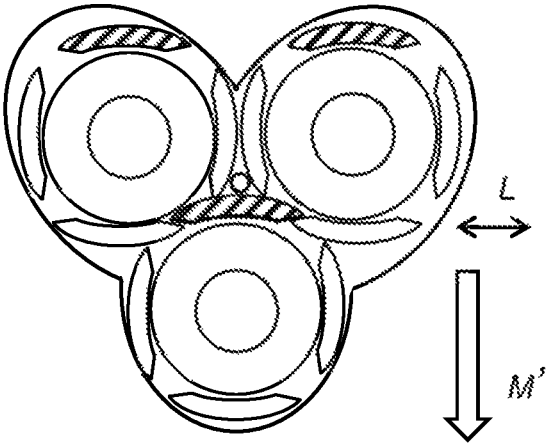
FIGS. 7*a* and 7*b* illustrate two options of selectively activating the controlled friction areas of the rotary shaver of FIG. 6 depending on an actual motion direction of the rotary shaver.
Figure 7B:
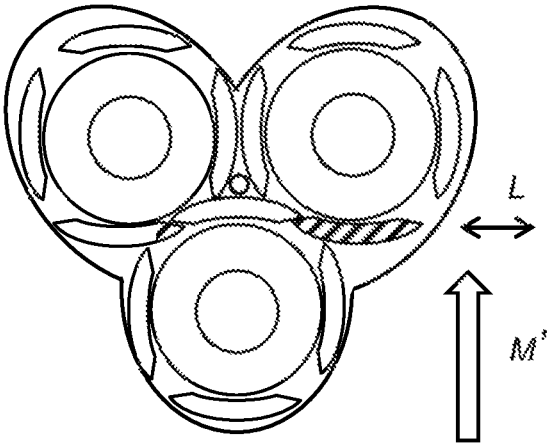

In the situation shown in FIG. 7*a*, the actual motion direction M' of the rotary shaver 100A is indicated by means of an arrow pointing downwards. In that case, the strips 124 of the controlled friction areas 122 which are present on a side of the heads 102 which is a top side in the representation of FIG. 7*a* are put in motion in a direction L transverse to the actual motion direction M' of the rotary shaver 100A, whereas the strips 124 of the other controlled friction areas 122 are kept in a stationary condition. In FIGS. 7*a* and 7*b*, the active controlled friction areas 122 are indicated by means of hatching.

In the situation shown in FIG. 7*b*, the actual motion direction M' of the rotary shaver 100A is indicated by means of an arrow pointing upwards. Hence, the actual motion direction M' as mentioned is the opposite of the actual motion direction M' which is applicable to the situation shown in FIG. 7*a*. In this opposite case, the strips 124 of the controlled friction areas 122 which are present on a side of the heads 102 which is a bottom side in the representation of FIG. 7*b* are put in motion in a direction L transverse to the actual motion direction M' of the rotary shaver 100A, whereas the strips 124 of the other controlled friction areas 122 are kept in a stationary condition.

The configuration in which each skin treatment member or head 102 is surrounded by four controlled friction areas 122 is only one example of the practical possibilities existing within the framework of the invention. For instance, it is also possible for the controlled friction areas 122 to be only arranged at the periphery of the face plate 104, wherein only those areas 122 which are in a trailing position as seen in the actual motion direction M' of the rotary shaver 100A are activated in an actual situation.

In the embodiment of FIG. 6, the shaver 100A according to the invention is equipped with sensing means for determining the actual motion direction M' of the rotary shaver 100A over the skin during use, which may be of any suitable type. The actual motion direction M' is a further example of a first parameter related to the friction between the skin contacting surface and the skin S, in particular a parameter which influences said friction, in particular the direction of said friction. The sensing means may be, for example, an optical direction sensor 138, which is located at the center of the face plate 104, and which is operatively connected to the controller 134. During use, the optical sensor 138 takes images at a certain frequency, e.g. a frequency of around 30 Hz, and the controller 134 calculates a motion vector based on the differences between successive images. Instead of the optical sensor 138, another type of sensor may be used to measure the actual motion direction M' and/or the velocity of the shaver 100A, for example a mechanical velocity sensor or an accelerometer. The controller 134 uses the motion vector, and also the velocity of the motion of the rotary shaver 100A relative to the skin, to determine the actual motion direction M'. Based on this measurement, the controller 134 is capable of determining which controlled friction areas 122 are in a trailing position relative to the heads 102, seen in the detected actual motion direction M', and thus should be activated in order to realize slip motion of the skin contacting surface at the positions of those controlled friction areas 122, and which controlled friction areas 122 are in other positions and thus should not be activated. Furthermore, the controller 134 is capable of setting a value of the maximum velocity of the reciprocating motion of the actuated strips 124, or a value of another parameter of the reciprocating motion, such as the frequency or amplitude, or a combination of parameters of the reciprocating motion. In this way, as explained in the foregoing, the friction in the trailing positions of the skin contacting surface is reduced, on the basis of which it is possible to have improved grip on the skin S, reduce skin doming, and/or maintain the degree of skin doming at an optimum value.

Figure 8A:
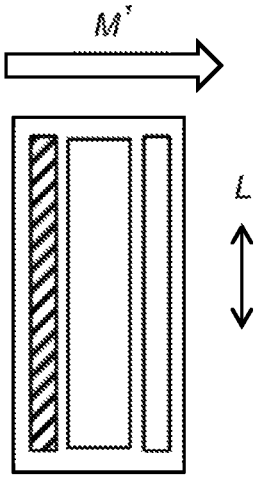
FIGS. 8*a* and 8*b* schematically show a linear shaver according to the invention, comprising a set of blades and controlled friction areas arranged on either side of the set of blades, wherein two options for selectively activating the controlled friction areas, depending on an actual motion direction of the linear shaver, are illustrated.
Figure 8B:
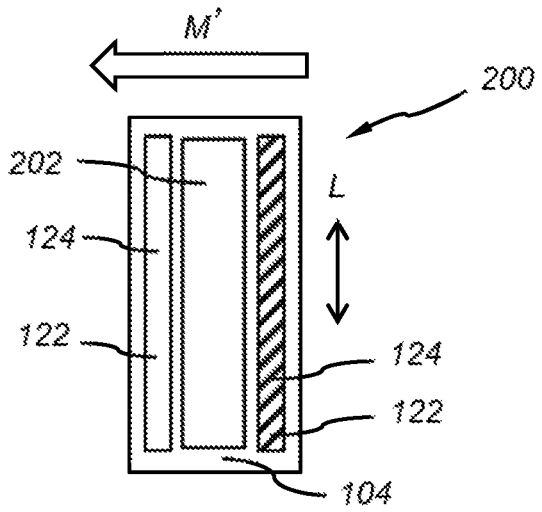

The invention is applicable to many other skin treatment devices besides a rotary shaver. FIGS. 8*a* and 8*b* relate to a linear shaver 200 according to the invention, comprising a face plate 104 in which both a set of blades 202 and controlled friction areas 122 are arranged. The controlled friction areas 122 are positioned on either side of the set of blades 202 and may comprise one or more movably arranged strips 124 as explained in the foregoing. The linear shaver 200 has sensing means to at least detect the actual motion direction M' of the shaver 200 relative to the skin during use, which may include a sensor similar to the optical direction sensor 138 of the shaver 100A of FIG. 6.

In the situation shown in FIG. 8*a*, the actual motion direction M' of the face plate 104 is indicated by means of an arrow pointing to the right. In that case, the strips 124 of the controlled friction areas 122 which are present on a side of the set of blades 202 which is a left side in the representation of FIG. 8*a* are put into a slip motion in a direction L transverse to the actual motion direction M' of the linear shaver 200, whereas the strips 124 of the other controlled friction areas 122 are kept in a stationary condition. In FIGS. 8*a* and 8*b*, the active controlled friction areas 122 are indicated by means of hatching.

In the situation shown in FIG. 8*b*, the actual motion direction M' of the linear shaver 200 is indicated by means of an arrow pointing to the left. Hence, the actual motion direction M' as mentioned is the opposite of the actual motion direction M' which is applicable to the situation shown in FIG. 8*b*. In this opposite case, the strips 124 of the controlled friction areas 122 which are present on a side of the set of blades 202 which is a right side in the representation of FIG. 8*b* are put into a slip motion in a direction L transverse to the actual motion direction M' of the linear shaver 200, whereas the strips 124 of the other controlled friction areas 122 are kept in a stationary condition.

Under the influence of the active controlled friction areas 122, it is possible to obtain a skin stretching effect during use of the linear shaver 200, as a result of which skin irritation can be reduced.

Figure 9A:
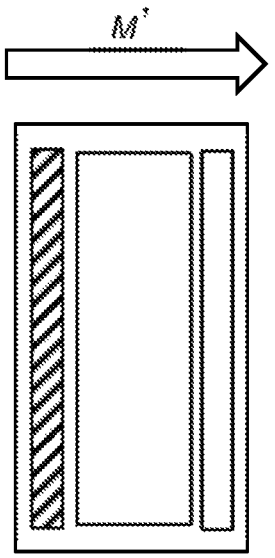
FIGS. 9*a* and 9*b* relate to a photo-epilator according to the invention, comprising a light source and controlled friction areas arranged on either side of the light source, wherein two options for selectively activating the controlled friction areas, depending on an actual motion direction of the photoepilator, are illustrated.
Figure 9B:
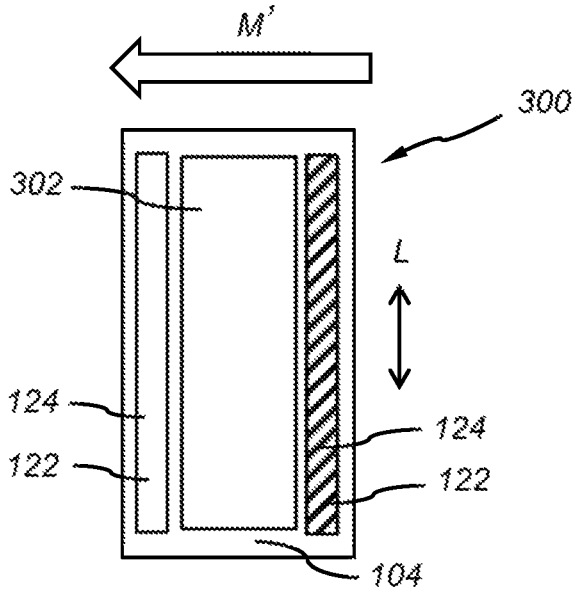

FIGS. 9*a* and 9*b* relate to a photo-epilator 300 according to the invention, comprising a face plate 104 in which both a light source 302 and controlled friction areas 122 are arranged. The controlled friction areas 122 are positioned on either side of the light source 302 and may comprise one or more movably arranged strips 124 as explained in the foregoing. The photo-epilator 300 has sensing means to at least detect the actual motion direction M' of the photo-epilator 300 relative to the skin during use, which may include a sensor similar to the optical direction sensor 138 of the shaver 100A of FIG. 6.

In the situation shown in FIG. 9*a*, the actual motion direction M' of the photo-epilator 300 is indicated by means of an arrow pointing to the right. In that case, the strips 124 of the controlled friction areas 122 which are present on a side of the light source 302 which is a left side in the representation of FIG. 9*a* are put into a slip motion in a direction L transverse to the actual motion direction M' of the photo-epilator 300, whereas the strips 124 of the other controlled friction areas 122 are kept in a stationary condition. In FIGS. 9*a* and 9*b*, the active controlled friction areas 122 are indicated by means of hatching.

In the situation shown in FIG. 9*b*, the actual motion direction M' of the photo-epilator 300 is indicated by means of an arrow pointing to the left. Hence, the actual motion direction M' as mentioned is the opposite of the actual motion direction M' which is applicable to the situation shown in FIG. 9*a*. In this opposite case, the strips 124 of the controlled friction areas 122 which are present on a side of the light source 302 which is a right side in the representation of FIG. 9*b* are put into a slip motion in a direction L transverse to the actual motion direction M' of the photo-epilator 300, whereas the strips 124 of the other controlled friction areas 122 are kept in a stationary condition.

Under the influence of the active controlled friction areas 122, it is possible to obtain a skin stretching effect during use of the photo-epilator 300, which may be beneficial to the functioning of the photo-epilator 300.

Figure 10:
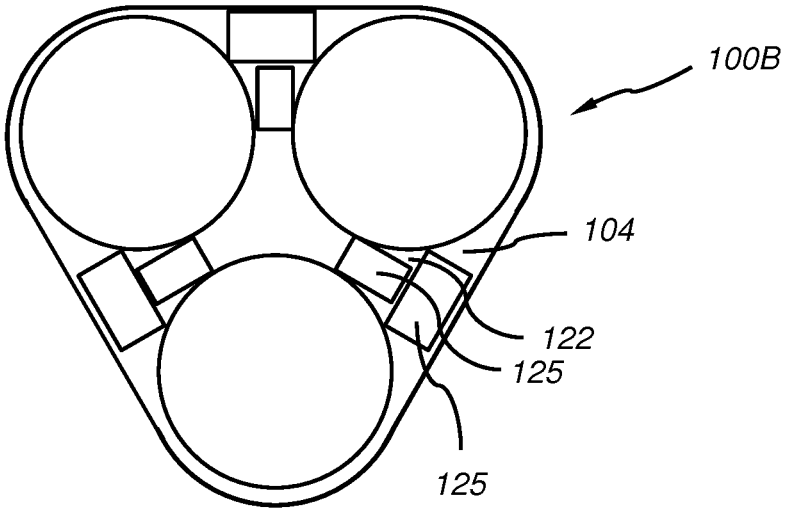
FIG. 10 shows a frontal view of a skin contacting surface of an alternative rotary shaver according to the invention, including a number of motorized rollers.

FIG. 10 shows a frontal view of a face plate 104 of an alternative rotary shaver 100B according to the invention in order to illustrate a different option from the one having reciprocating strips 124 in the controlled friction areas 122. In particular, according to the alternative option, motorized rollers 125 are used instead of elongated strips 124. During operation of the rotary shaver 100B, the rollers 125 are preferably driven such as to perform a continuous rotation about their longitudinal axes in order to realize a slip motion of a continuous nature, which does not alter the fact that it is also possible to have a reciprocating rotation of the rollers 125 if so desired, in order to realize a slip motion of a reciprocating nature like the slip motion associated with the strips 124. The shaver 100B has sensing means to at least detect the actual motion direction of the shaver 100B relative to the skin during use, which may include a sensor similar to the optical direction sensor 138 of the shaver 100A of FIG. 6.

In case rollers 125 are applied as described in the foregoing, it is preferred to have sets of two perpendicular rollers 125, so that it is possible to always have a roller 125 whose direction of rotation deviates from the actual motion direction of the rotary shaver 100B, and to actuate the roller 125 whose direction of rotation deviates from the actual motion direction to the largest extent in order to obtain an optimal local friction reducing effect. FIG. 10 shows only three sets of perpendicular rollers 125, but it will be understood that it is possible to have more sets of rollers 125, wherein it is preferred for the rollers 125 to be located at strategic positions as regards realizing a trailing position of the rollers 125 with respect to the various heads 102 arranged in the face plate 104 for a number of different motion directions of the rotary shaver 100B. In the embodiment of the rotary shaver 100B, the slip motion of each roller 125 is in a direction which is tangential to the outer surface of the roller 125 in a contact position where the outer surface of the roller 125 is in contact with the skin. In this contact position, the outer surface of the roller 125 forms part of the skin contacting surface of the rotary shaver 100B. Because said tangential direction corresponds to a local direction of extension of the outer surface of the roller in said contact position, also in the case of the rotary shaver 100B the direction of the slip motion corresponds to a local direction of extension of the skin contacting surface.

In the embodiments of the invention described here before, different examples of first parameters, related to the friction between the skin contacting surface 107 and the skin S, are measured in order to control the side slip motion of the controlled friction area 122. Said examples include parameters which are influenced by the friction, e.g. the amount of skin doming in the hair-entry aperture 108 in the embodiment of FIG. 3, and parameters which influence the friction, e.g. the actual motion direction M' in the embodiment of FIGS. 6 and 7. It is noted that, according to the invention, the side slip motion may also be controlled in dependence on a combination of these first parameters or other examples of such first parameters. Other examples of such first parameters include the normal force exerted by the skin on the skin contacting surface 107 or the moisture level at the interface between the skin contacting surface 107 and the skin, as examples of first parameters which influence the friction between the skin contacting surface 107 and the skin, and the skin temperature below the skin contacting surface 107, as an example of a first parameter which is influenced by the friction between the skin contacting surface 107 and the skin.

In case of measuring the normal force, the velocity of the side slip motion may be increased in case the measured normal force increases, which will reduce the friction coefficient and result in a stable friction force. The normal-force sensor can be integrated in the handle or in the treatment head of the skin treatment device and can be a sensor operating according to any generally known force sensing principle, such as the piezoresisitive, inductive, optical and piezoelectric principles.

In case of measuring moisture level at the interface between the skin contacting surface 107 and the skin, the velocity of the side slip motion may be increased in case the measured moisture level increases because, generally, moist skin results in a higher friction than dry skin.

In case of measuring the skin temperature below the skin contacting surface 107, the velocity of the side slip motion may be increased in case the measured temperature, or the temperature increase within a certain time period, of the skin in contact with the skin treatment device is above a predefined threshold value. In such a case, as a result of the increased side-slip motion velocity, the friction between the skin and the skin contacting surface and the accompanying dissipation of heat will decrease, causing a decrease of the skin temperature. The sensor can be a thermocouple, thermistor or other temperature sensor.

It will be clear to a person skilled in the art that the scope of the invention is not limited to the examples discussed in the foregoing, but that several amendments and modifications thereof are possible without deviating from the scope of the invention as defined in the attached claims. While the invention has been illustrated and described in detail in the figures and the description, such illustration and description are to be considered illustrative or exemplary only, and not restrictive. The invention is not limited to the disclosed embodiments.

Variations to the disclosed embodiments can be understood and effected by a person skilled in the art in practicing the claimed invention, from a study of the figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the invention.

Introducing slip motion into a controlled friction area 122 which is present at an appropriate position on the skin treatment device 100A, 100B, 200, 300 is a notable feature of the invention. This feature may be realized by applying one or more movably arranged strips 124 in the controlled friction area 122, or one or more rollers 125 which are rotatable about their longitudinal axes, as explained in the foregoing, but it is also possible to apply any other suitable type of means.

The invention claimed is:

1. A skin treatment device, comprising:

a skin treatment member for performing a skin treatment on skin to be treated, wherein the skin treatment member includes a blade adapted for cutting hair present on an area of the skin to be treated;

a skin contacting surface, separate from the blade, for contacting the skin;

a mount for mounting the skin treatment member and the skin contacting surface in the skin treatment device; and a friction controlling device comprising a reciprocating strip and configured and arranged to control friction between the skin contacting surface and the skin to be treated in a controlled friction area of the skin contacting surface during use when the skin contacting surface is moved over the skin to be treated;

wherein the friction controlling device is adapted to introduce a slip motion of the controlled friction area relative to the mount in a direction corresponding to a local direction of extension of the skin contacting surface;

wherein the skin treatment device comprises a sensor configured and arranged for detecting a first parameter, the first parameter being related to the friction between the skin contacting surface and the skin to be treated, during use, wherein the friction controlling device is adapted to control a second parameter of the slip motion in dependence on a value of the first parameter detected by the sensor, wherein the first parameter is an actual motion direction of the skin treatment device in which the skin treatment member cuts hair, wherein a user is able to move the skin treatment device such that the actual motion direction of the skin treatment device corresponds to a first direction during a first time and corresponds to a second direction, different from the first direction, during a second time, and wherein the friction controlling device is adapted to introduce the slip motion during the first time when the controlled friction area is in a trailing position relative to the skin treatment member along the actual motion direction of the skin treatment device in which the skin treatment member cuts hair, and to prevent the slip motion during the second time when the controlled friction area is in a leading position relative to the skin treatment member along the actual motion direction of the skin treatment device in which the skin treatment member cuts hair.

2. The skin treatment device of claim 1, wherein the friction controlling device comprises a plurality of parallel strips, the reciprocating strip is a member of the plurality of parallel strips, the plurality of parallel strips is movable relative to the mount in a longitudinal direction of the plurality of parallel strips, and the plurality of parallel strips extend alongside each other in the controlled friction area, the skin treatment device further comprising an electro-active polymer strip for realizing a reciprocating motion of the plurality of parallel strips according to an alternating pattern, wherein adjacent strips among the plurality of parallel strips are moved in opposite directions.

3. The skin treatment device of claim 1, wherein the skin treatment member further comprises a guard having a skin engaging portion, wherein the controlled friction area is located alongside a periphery of the skin engaging portion.

4. The skin treatment device of claim 1, wherein the second parameter is a maximum velocity of the slip motion, and wherein the friction controlling device is adapted to set said maximum velocity to a value in a range of 1 to 100 mm/s.

5. The skin treatment device of claim 1, wherein the slip motion is a reciprocating slip motion of the controlled friction area, wherein the second parameter is a frequency of the slip motion, and wherein the friction controlling device is adapted to set said frequency in a range of 0.1 to 100 Hz.

6. The skin treatment device of claim 1, wherein the slip motion is a reciprocating slip motion of the controlled friction area, wherein the second parameter is an amplitude of the slip motion, and wherein the friction controlling device is adapted to set said amplitude in a range of 0.1 to 10 mm.

7. The skin treatment device of claim 1, wherein the friction controlling device comprises the reciprocating strip, which is movable relative to the mount in a longitudinal direction of the reciprocating strip.

8. The skin treatment device of claim 7, comprising a responsive-material actuating device for realizing a reciprocating motion of the reciprocating strip relative to the mount in the longitudinal direction.

9. The skin treatment device of claim 8, wherein the responsive-material actuating device comprises an electro-active polymer.

10. A skin treatment device, comprising:

a skin treatment member for performing a skin treatment on skin to be treated, wherein the skin treatment member comprises a blade adapted for cutting hair present on an area of the skin to be treated;

a first sensor configured to sense a motion direction of the skin treatment member;

a skin contacting surface, separate from the blade, for contacting the skin;

a mount for mounting the skin treatment member and the skin contacting surface in the skin treatment device; and a friction controlling device comprising a reciprocating strip that reciprocates at a set frequency, the friction controlling device being configured and arranged to control friction between the skin contacting surface and the skin to be treated in a controlled friction area of the skin contacting surface during use when the skin contacting surface is moved over the skin, wherein the controlled friction area excludes the blade;

wherein the friction controlling device is adapted to introduce a slip motion of the controlled friction area relative to the mount in a direction corresponding to a local direction of extension of the skin contacting surface and deviating from the motion direction, wherein the slip motion causes a slip between the controlled friction area and the skin to reduce friction between the controlled friction area and the skin;

wherein the skin treatment device further comprises a second sensor configured and arranged for detecting a first parameter, the first parameter being related to the friction between the skin contacting surface and the skin to be treated, during use, wherein the friction controlling device is adapted to control a second parameter of the slip motion in dependence on a value of the first parameter detected by the second sensor, wherein the skin contacting surface is provided with a hair-entry aperture via which the hair is provided to the blade, and wherein the first parameter is an amount of skin doming in the hair-entry aperture during use.

11. The skin treatment device of claim 10, wherein the friction controlling device comprises a plurality of parallel strips, the reciprocating strip is a member of the plurality of parallel strips, the plurality of parallel strips is movable relative to the mount in a longitudinal direction of the plurality of parallel strips, and the plurality of parallel strips extend alongside each other in the controlled friction area, the skin treatment device further comprising an electro-active polymer strip for realizing a reciprocating motion of the plurality of parallel strips according to an alternating pattern, wherein adjacent strips among the plurality of parallel strips are moved in opposite directions.

12. The skin treatment device of claim 10, wherein the second parameter is a maximum velocity of the slip motion, and wherein the friction controlling device is adapted to set said maximum velocity to a value in a range of 1 mm/s to 100 mm/s.

13. The skin treatment device of claim 10, wherein the slip motion is a reciprocating slip motion of the controlled friction area, wherein the second parameter is the set frequency of the slip motion, and wherein the friction controlling device is adapted to set the set frequency in a range of 0.1 Hz to 100 Hz.

14. The skin treatment device of claim 10, wherein the slip motion is a reciprocating slip motion of the controlled friction area, wherein the second parameter is an amplitude of the slip motion, and wherein the friction controlling device is adapted to set said amplitude in a range of 0.1 to 10 mm.

15. A skin treatment device, comprising:

a skin treatment member for performing a skin treatment on skin to be treated, wherein the skin treatment member includes a blade adapted for cutting hair present on an area of the skin to be treated;

at least one sensor configured to sense a motion direction of the skin treatment member;

a skin contacting surface, separate from the blade, for contacting the skin;

a mount for mounting the skin treatment member and the skin contacting surface in the skin treatment device;

a friction controlling device comprising a reciprocating strip and configured and arranged to control friction between the skin contacting surface and the skin to be treated in a controlled friction area of the skin contacting surface during use when the skin contacting surface is moved over the skin to be treated, wherein the reciprocating strip is movable relative to the mount in a longitudinal direction of the reciprocating strip; and a responsive-material actuating device for realizing a reciprocating motion of the reciprocating strip relative to the mount in the longitudinal direction, wherein the friction controlling device is adapted to introduce a slip motion of the controlled friction area relative to the mount in a direction corresponding to a local direction of extension of the skin contacting surface and deviating from the motion direction;

wherein the at least one sensor configured and arranged for detecting a first parameter, the first parameter being related to the friction between the skin contacting surface and the skin to be treated, during use, wherein the friction controlling device is adapted to control a second parameter of the slip motion in dependence on a value of the first parameter detected by the at least one sensor, wherein the responsive-material actuating device comprises two elongated electro-active polymer strips of an expandable material, wherein first end portions of the two elongated electro-active polymer strips are connected to, respectively, a first end portion of the reciprocating strip and a second end portion of the reciprocating strip, and wherein second end portions of the two elongated electro-active polymer strips are connected to the mount of the skin treatment device in positions in a vicinity of, respectively, the second end portion of the reciprocating strip and the first end portion of the reciprocating strip.

16. The skin treatment device of claim 15, wherein the first parameter is the motion direction of the skin treatment member during use in which the skin treatment member cuts hair, wherein a user is able to move the skin treatment device such the motion direction of the skin treatment member corresponds to a first direction during a first time, and corresponds to a second direction different from the first direction during a second time, and wherein the friction controlling device is adapted to introduce the slip motion during the first time when the controlled friction area is in a trailing position relative to the skin treatment member with respect to the motion direction of the skin treatment member in which the skin treatment member cuts hair, and wherein the friction controlling device is adapted to prevent the slip motion during the second time when the controlled friction area is in a leading position relative to the skin treatment member with respect to the motion direction of the skin treatment member in which the skin treatment member cuts hair.

17. The skin treatment device of claim 15, wherein the first parameter is an actual velocity of the skin treatment device relative to the skin to be treated, during use.

18. The skin treatment device of claim 15, wherein the skin contacting surface is provided with a hair-entry aperture via which the hair is provided to the blade, and wherein the first parameter is an amount of skin doming in the hair-entry aperture during use.

19. The skin treatment device of claim 15, wherein the second parameter is a maximum velocity of the slip motion, and wherein the friction controlling device is adapted to set said maximum velocity to a value in a range of 1 to 100 mm/s.

* * * * *